US005442524A

United States Patent [19]

Farmer

[11] Patent Number: 5,442,524

[45] Date of Patent: Aug. 15, 1995

[54] SECURITY ENHANCEMENT APPARATUS

[76] Inventor: Larry Q. Farmer, 9037 E. 29th Pl., Tulsa, Okla. 74129-6819

[21] Appl. No.: 92,066

[22] Filed: Jul. 16, 1993

[51] Int. Cl.[6] ..... F21V 21/30

[52] U.S. Cl. ..... 362/35; 362/284; 362/324

[58] Field of Search ..... 362/35, 234, 251, 276, 362/284, 324, 802, 811, 294, 373; 40/441, 431

[56] References Cited

U.S. PATENT DOCUMENTS

| | | | |
|---|---|---|---|
| 2,611,071 | 9/1952 | Palmieri | 240/10.1 |
| 3,393,310 | 7/1968 | Ream | 240/10 |
| 3,885,865 | 5/1975 | Stern et al. | 353/2 |
| 4,285,028 | 8/1981 | Sundin et al. | 362/35 |
| 4,288,784 | 9/1981 | Fusco | 362/35 X |
| 4,858,079 | 8/1989 | Ohashi | 362/35 |
| 4,955,714 | 9/1990 | Stoler et al. | 353/62 |

*Primary Examiner*—Stephen F. Husar

[57] ABSTRACT

An apparatus for providing enhanced security and the deterrence of unauthorized or illegal entry into residential or commercial premises by the creation of the perception of occupancy in an outside observer, by passing differing patterns of light and shadow across the surfaces of translucent window coverings in a seemingly random sequence and at varying speed and frequency while also causing the illumination and extinguishment of a secondary llight source in another part of the structure at irregular intervals for variable periods of time.

20 Claims, 2 Drawing Sheets

SECURITY ENHANCEMENT APPARATUS

BACKGROUND OF THE INVENTION

It has long been recognized in the commercial and industrial communities and generally accepted in the insurance, security and property protection industries that losses by theft and vandalism may be greatly reduced through the employment of sophisticated electronic surveillance systems and the physical presence of security personnel. These security measures however, come only at considerable expense, not only for their initial installation and maintenance, but also for the ongoing cost of manning and monitoring them. Unfortunately, the community of thieves, burglars and assorted miscreants who are responsible for the requirement for such systems have become adept in dealing with these electronic devices and have devised a number of means for by-passing or circumventing the systems, resulting in the requirement for increased numbers of security personnel and a consequent further increase in security expense. In the commercial and industrial areas the costs associated with security are passed on to the consumer and are contributory to economic inflation.

In the residential sector many different means of deterrence to unauthorized intrusion are available to supplement regular police patrols, ranging from complex electronic audio and visual surveillance, with window and door sensors, motion detectors, central monitoring and private drive-by security patrols, which are beyond the economic means of most homeowners, to the most simple electric timers which turn lights on at dusk and off at bedtime to give a residence the appearance of occupancy.

There appears to be a statistically provable consensus in the loss-prevention industry, that while electronic protection is infinitely more desirable than none at all, the greatest deterrent to unauthorized intrusion is the physical presence or human occupancy. This consensus would appear to be validated by the fact that large numbers of residential burglaries are perpetrated during the hours of daylight when the occupants of those residences are at their places of work or education. The average, if indeed there be such, house burglar apparently fears confrontation and possible identification and meticulously avoids invasion of occupied premises. Fearing apprehension, the burglar is generally unarmed as he goes about his work, for he does not anticipate challenge and will face a lesser charge than if apprehended while in possession of a weapon. Communications devices, such as the telephone and the answering machine associated therewith tend to serve the miscreant in the pursuit of likely targets for his craft. A telephone that goes unanswered following ten continuous minutes of ringing, which may be audible from outside a targeted residence, is a reasonably good indication that no one is at home, as is the telephone which is answered by a machine several times over the course of a few minutes. The simple expedient of a telephone bell switch to disconnect the ringer of the telephone at times when the residence is unoccupied negates the possibility of determining occupancy by this method, as the miscreant, unable to hear the telephone ringing from outside the residence, cannot be certain that the number which he has dialed is, in fact, the number of the targeted residence, thus causing him to seek another target.

The hours of darkness present yet another set of clues as to the status of occupancy of a residence or place of business. A residence, or a place of business, which is unlighted during at least the early hours of darkness is a ready indication of the lack of human occupancy and is thus an open invitation to burglary. As a corrective measure, a number of adjustable, electric timers having the ability to energize and de-energize electric circuitry to illuminating devices at pre-selected times have become commercially available. While these timer switches do indeed give the impression that someone who is operating these lighting devices is present within the structure, the very precision with which these timers activate and deactivate the lights diminishes their value as a deterrent to illegal entry and theft, i.e., the clock-like precision imparted to these devices by the synchronous motors which power them, cause the lights to be energized and de-energized at exactly the same time each day. It is highly unlikely that any individual is so precise in his daily routine that he would illuminate and extinguish lights at the exact same second each and every day, an action not likely to be overlooked by a professionally meticulous thief in searching for a likely target upon which to practice his nefarious craft.

The prior art fails to reveal development of invention for the purpose of deterrence of unauthorized entry by this means and only five examples of radial light projecting devices were discovered. Palmieri, in U.S. Pat. No. 2,611,071 disclosed an "Electric Lamp Having a Revolvable Shade Structure;" Ream in U.S. Pat. No. 3,393,310 an "Ornamental Display Device;" Steam, et al. in U.S. Pat. No. 3,885,865 an "Automatic Kaleidoscope;" Ohashi in U.S. Pat. No. 4,858,079 a "Light Projecting Toy Musical Box;" and Stotler, et al., a "System for Stimulating the Appearance of the Night Sky Inside a Room." The first three of these inventions rely upon the heat generated by an electric lamp for their activation, the fourth upon spring-powered clock work, while the fifth simply projects star-like images upon a ceiling and imparts no movement.

OBJECT OF THE INVENTION

It is the object of the present invention to provide enhanced security in the residential environment through the provision of an apparatus which gives the perception of activity, movement or occupancy within a house, apartment or place of business, when viewed from the exterior during the hours of darkness, by causing the seemingly random passage of light and shadow upon the inner translucent surfaces of window coverings and causing the periodic illumination and extinguishment of a secondary, remotely located, light source, said apparatus being effective, simple, practical, easy to operate and of a cost which is well within the financial means of the average individual.

While electronic security measures are extremely beneficial in detecting intrusion, recording the activities of the intruder(s) and notifying security personnel of the incursion, it is necessary that entry be gained, or at least attempted, for such systems to activate. Additionally, considerable damage may occur to this type of security equipment as the miscreants attempt to either circumvent the systems, (which may or may not be possible) and destroy video and still cameras to prevent a recording of their activities and their possible identification.

Response time, the time which elapses between the receipt of alarm and the on-scene arrival of security or police personnel, may be sufficient to allow the intruder to enter, acquire goods or merchandise, exit and depart the scene.

As statistics indicate that occupancy is the best means of deterrence of illegal entry it becomes apparent that the perception of occupancy of a residence or place of business provides an excellent means to discourage entry for the purpose of clandestine burglary. The present invention addresses and solves the problem of providing this perception by providing an apparatus which causes the appearance of irregular motion behind closed shades, blinds, draperies or other translucent window coverings, by causing shadows to be cast upon these window coverings by causing opaque objects to pass between them and a principal interior light source on a credibly irregular schedule and by causing a secondary light source to be periodically illuminated and extinguished on a random basis.

THE PREFERRED EMBODIMENT OF THE INVENTION

Figure 1:
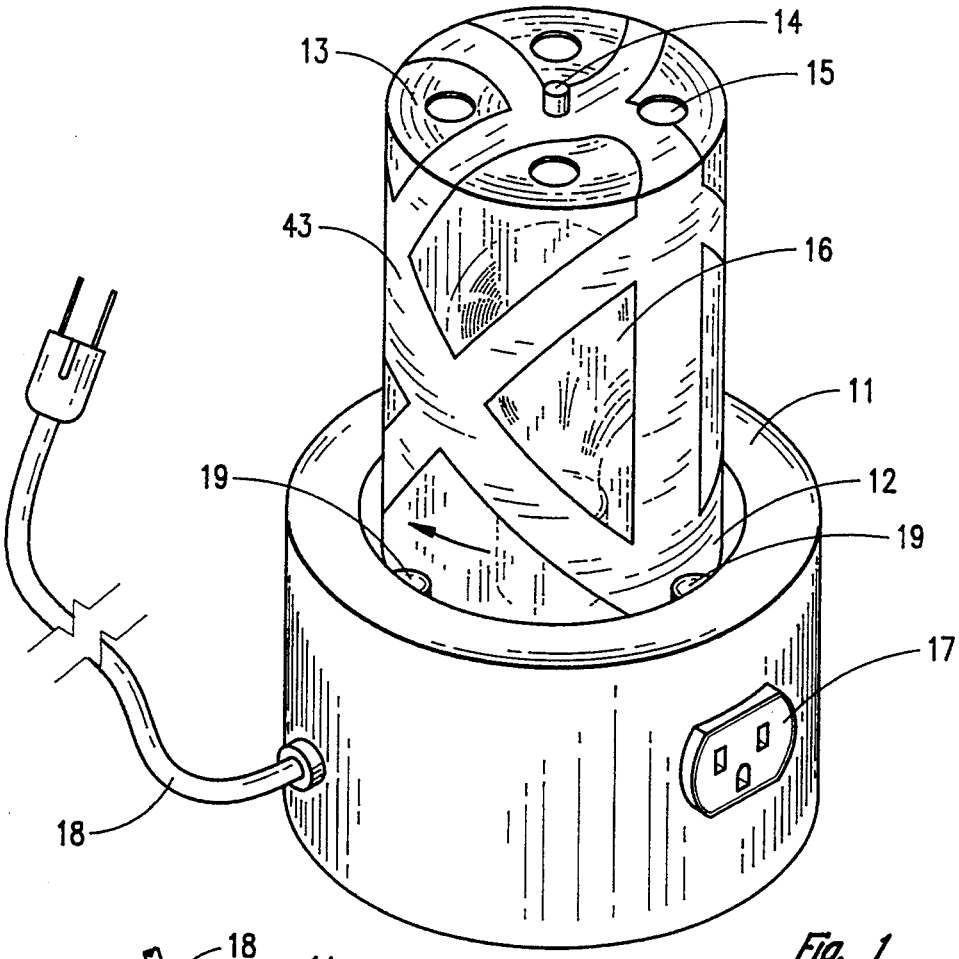
FIG. 1 is an overall isometric view of the present invention illustrating the primary light source, rotating element, power cord and switched secondary light source receptacle.
Figure 2:
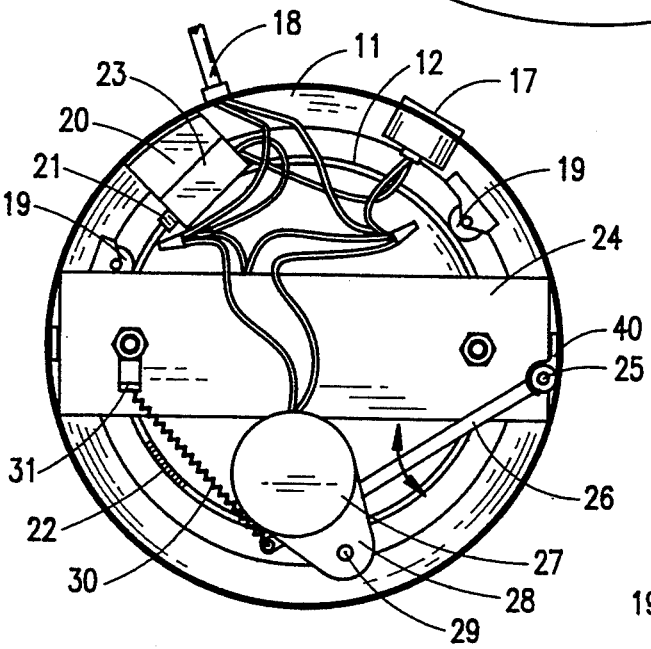
FIG. 2 is a bottom view of the apparatus illustrating the chassis or base, the rotating element, centralizing idler rollers, secondary light source switch, power cord, switched secondary light source receptacle, pictorial wiring and drive motor with reduction gearing and mounting and tensioning means.
Figure 3:
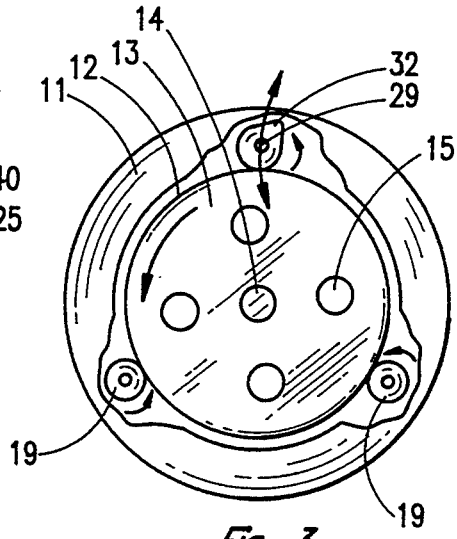
FIG. 3 is a cut-away top view of the apparatus illustrating the chassis or base cut-away to reveal the positions of the centralizing idler rollers and the motor-powered drive cam in engagement with the rotating element.
Figure 4:
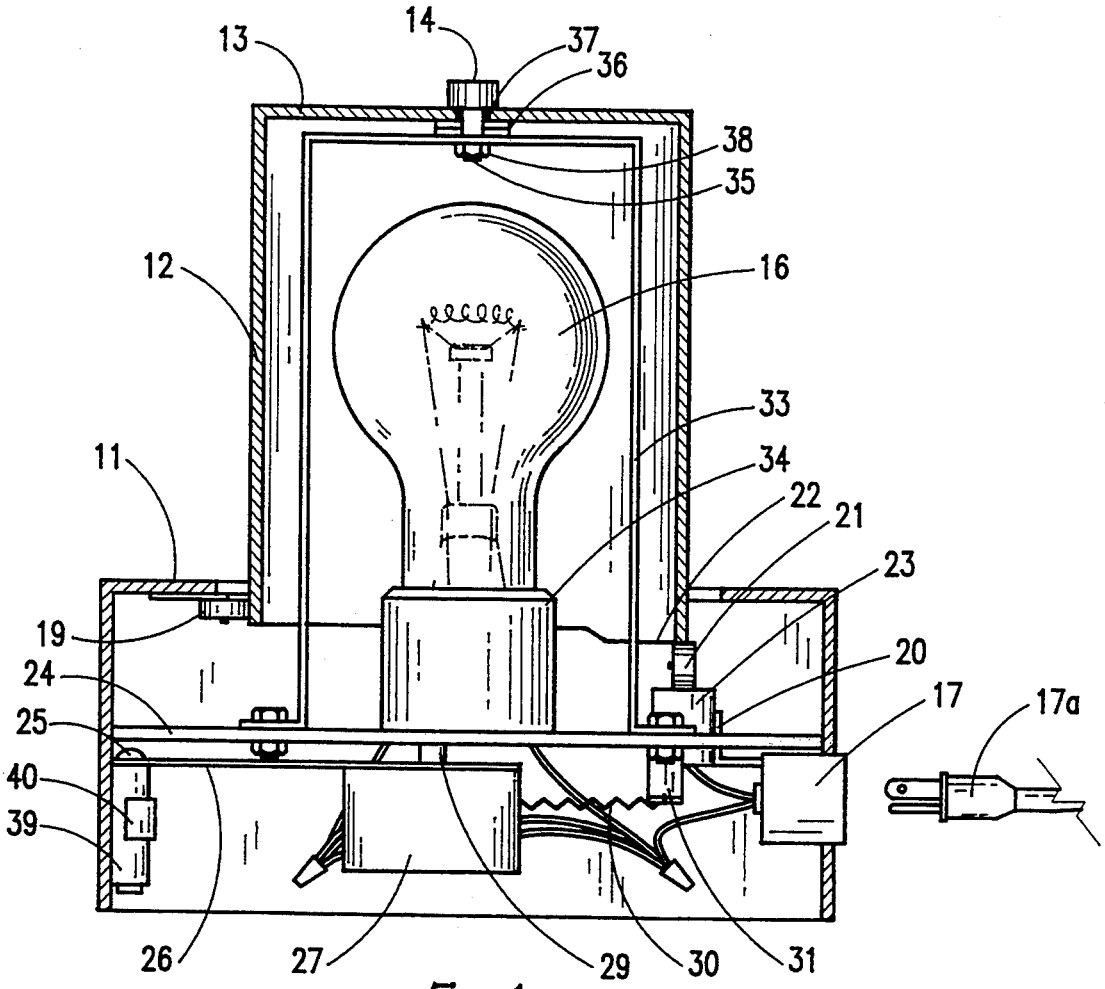
FIG. 4 is a cut-away view of the apparatus illustrating the placement of the components thereof and depicting the method of support of the rotating element and drive motor and reduction gearing.
Figure 5:
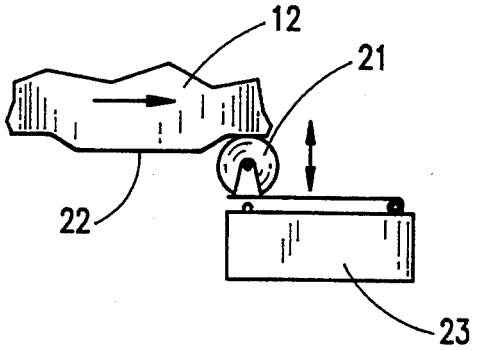
FIG. 5 is a detail view of the lower edge of the rotating element and auxiliary receptacle switch depicting the manner in which a camlike section of the lower edge of the rotating element contacts the roller of the switch to energize and de-energize the auxiliary receptacle.
Figure 6:
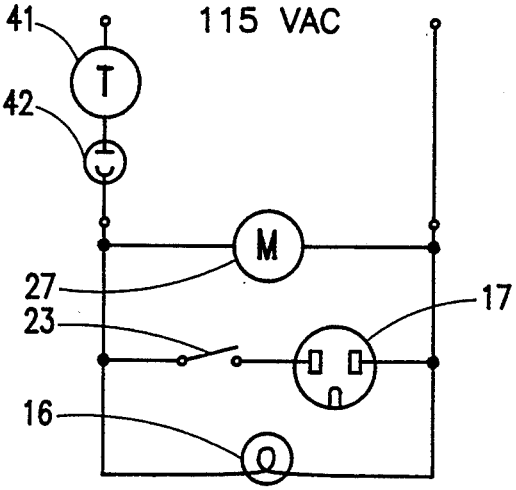
FIG. 6 is schematic wiring diagram of the apparatus.

Referring now to the Figures of the Drawings, which illustrate the preferred embodiment of the present invention, will reveal the construction and operation of the apparatus and will cause it to be more readily understood. FIG. 1 illustrates the external appearance of the complete apparatus which comprises a base member 11 of a cylindrical, square, octagonal or other configuration, constructed of metal, wood or a suitable plastic, having vertical walls and a round flanged opening at the upper end thereof, said opening being sized to loosely accommodate a transparent, powered, cylindrical rotating element 12, said element being constructed of glass or of a suitable transparent plastic, said element being suitably supported internally and adapted for centralized powered rotation about a central axis and within the flanged upper end of said base 11, said transparent, powered, cylindrical rotating element having random, opaque designs 43 on and about approximately 40 percent of the vertical cylindrical and horizontal top surfaces thereof, said element being open at the lower end thereof and closed at the upper end 13 and having a centrally located bore which passes over a stud-like axis and is provided with a retaining nut means 14. Said closed end 13 comprising a plurality of spaced apart, radially situate, ventilating holes 15 to aid in the dissipation of heat generated by a clear (unfrosted) incandescent lamp 16, (preferably having a straight vertical filament), enclosed within said transparent rotating element 12. Base member 11 also serves as a location for the fixed attachment of a randomly switched electrical receptacle 17 and as an anchor point for an electrical supply cord 18 which passes therethrough into the interior of said base member. Also depicted in this Figure are two rotatable centralizing rollers 19 which are fixedly attached to the lower surface of the flanged portion of base member 11 by riveting or any other suitable means, said rollers being adapted to maintain said rotating cylindrical element in the center of the flanged opening of said base 11 and allow the entry and passage of cooling air, said passage being convectively induced by the heat generated by incandescent lamp 16. Upon absorption of a portion of the heat generated by said lamp, said heated air, being thus lightened, rises to exit the chimney-like cylindrical element by way of ventilating holes 15 provided for that purpose. In FIG. 2 the apparatus is illustrated in an inverted position depicting the base member 11, the transparent, powered, cylindrical rotating element 12, a randomly switched electrical receptacle 17, the entry of the electrical supply cord 18 and additionally depicts the two fixed centralizing rollers 19, spaced about the inner periphery of the flanged opening of base member 11, separated by an angle of 120°, a switch mounting bracket 20, a switch actuating roller 21, in spring loaded engagement with the lower peripheral edge of rotating element 12 and a cam portion 22 of said rotating element configured to actuate roller 21 of switch 23. Also illustrated in this Figure is the lamp socket and rotating element support bracket mounting platform 24, a pivotally mounted 25 drive motor support arm 26 and a synchronous electric drive motor 27 with reduction gearing 28 which causes a rotational speed on the order of one revolution per minute of reduction gear output shaft 29 and an extension spring 30 attached between the distal end of drive motor support arm 26 and spring bracket 31 which urges the drive motor and it's appurtenant gearcase 28, vertically extending reduction gear output shaft 29 and drive cam 32 (FIG. 3) toward the center of the apparatus and brings to and maintains said drive cam 32 in driving engagement with the lower external peripheral surface of rotating element 12 while causing said rotating element to engage and bear against the two centralizing rollers 19 thus maintaining said rotating element in the center of the opening of the flanged portion of base member 11. The wiring of the various electrical components is illustrated in pictorial form. In a cut-away overhead view of the apparatus FIG. 3 depicts the base 11, as viewed from above, showing transparent cylindrical rotating element 12, closed end 13 of said element, centrally situate retaining nut means 14, heat dissipating holes 15 and additionally depicts the upper end of reduction gear output shaft 29, transparent cylindrical element drive cam 32 and two centralizing rollers 19 which are rotatably mounted on said base member 11. The partially sectionalized view of FIG. 4 shows to advantage the internal structure of the apparatus wherein a rotating element support bracket 33 of a substantially rectangular configuration, having outwardly turned portions, to facilitate attachment by any conventional means at the lower ends thereof and lamp socket 34 are suitably attached to lamp socket and rotating element support bracket platform 24 which diametrically traverses the interior of base 11 to which it is fixedly attached thereto by conventional means. A short stud-like bolt 35, having threads at both ends thereof, extends upwardly from a threaded bore situate the mid-point of the upper horizontal portion of rotating element support bracket 33 where it is retained and prevented from departure or rotation by the provision of a machine nut 38 in locking engagement with the lower surface of said support bracket 33. Note: Said bolt 35 may also be retained in fixed engagement with said rotating element support bracket 33 by any other conventional and suitable means, such as peening or riveting, but is here illustrated only as has it's attachment thereto been realized in the prototypical reduction-to-practice of the present invention. Said bolt 35, extends upwardly from said support bracket 33 and passes through washers or spacers 36 provided to prevent interference and allow adjustment between said support bracket and the interior surface of the upper closed end 13 of said rotating element 12 and continues upwardly through a slightly oversized bore 37 at the diametric center of the upper closed end 13 of transparent, cylindrical rotating element 12. The upper-most threaded end of said stud-like bolt 35 accommodates the installation of a correspondingly threaded, knurled, fluted or otherwise ornamental nut 14 provided for the purpose of retaining said rotating element and counter-acting and discouraging any tendency toward upward departure which may be imparted by the spring-loading of roller 21 of switch 23. Also depicted in this Figure (as in FIG. 2) is the pivotal attachment 25 provided for a synchronous electric drive motor 27 and appurtenant motor output speed reduction gearing 28 the output shaft 29 of which is caused to rotate at a speed on the order of one revolution per minute, wherein said motor is fixedly attached to drive motor support arm 26 which has at one end thereof a fixedly attached, downwardly extending pivot pin 25 which is journaled in a vertically disposed tubular bushing 39 which is fixedly attached to the interior vertical wall of base 11 by clamp 40 (FIGS. 2 and 4) or other suitable means. Pivotally attached in this manner the synchronous drive motor 27, speed reduction gearing 28 (not shown in this Figure) and upwardly extending output shaft 29 are urged toward the center of the diameter of the apparatus by virtue of a tension spring 30 attached between the distal end of motor support arm 26 and spring bracket 31 causing drive cam 32 (FIG. 2), having a thickness approximating ¼ inch (not shown), which is fixedly attached to the upper end of output shaft 29, to be dram into frictional driving engagement with the circumferential periphery of the transparent rotating element proximate the lower end thereof, causing said rotating element to bear against centralizing rollers 19 as it slowly and irregularly rotates in response to the frictional engagement of rotating drive cam 32. Said pivotal mounting adapts said unitary drive motor, reduction gear and output shaft to reciprocate in a slightly arcuate path in response to the contour of said cam in engagement with said rotating element. Note: The frictional engagement of the drive cam with the lower periphery of the rotating element may be enhanced by the application of a layer of a semi-soft vinyl tape on the peripheral face of the drive cam. Electrical tape was employed in the prototypical reduction-to-practice of the present invention. It will readily be understood that the rotating transparent element, thus driven by a cam, operates at variable and irregular rotational speeds, seldom casting a similar shadow at a similar speed across the window coverings. A roller 21 actuated switch 23, mounted upon a bracket 20 (shown to advantage in FIG. 2) which is fixedly attached to the interior vertical wall of base 11 by any suitable means is in rolling engagement with the lower edge of rotating element 12 which has one, or a plurality of, cam-like lobe(s) 22 situate thereupon for the purpose of depressing and releasing said roller 21 and actuating said switch 23 as cylindrical element 12 rotates, to cause the intermittent completion and interruption of an electrical circuit to electrical receptacle 17 into which an auxiliary remote light source may be connected by way of plug 17*a*. (As previously indicated, the period of illumination of said secondary light source is also predicated upon the irregular motion imparted by the drive cam, thus further enhancing the perception of a physical presence.) FIG. 5 is a detailed illustration of the manner in which the cam-like lobe(s) 22 on the lower edge of rotating element 12 alternately depress(es) and/or release(s) roller 21 causing the actuation of switch 23 in response to the rotation of element 12, thereby completing or interrupting the electrical circuit to receptacle 17. FIG. 6 is a simple schematic diagram of the electrical circuitry of the present invention indicating that the motor 27 and lamp 16 are constantly energized and the circuit to receptacle 17 is switched on and off by the action of cam 22 and roller 21. In practice the 115 Volt circuit which energizes the apparatus is switched on and off by a programmable timer 41 which may also operate in conjunction with a photo-electric cell 42 and relay, to assure that lights are operational prior to the onset of the hours of darkness and are extinguished at daybreak, or after a period of time pre-selected and programmed into the timer 41. The conjunctive operation of the timer with the photo-electric cell and relay in this manner, causes the apparatus to be energized in response to failing light conditions, rather than at a specific time, further enhancing the perception of occupancy of the premises.

The presently preferred embodiment of the current invention is a security enhancement apparatus which causes a nocturnal observer on the exterior of a residence or place of business to perceive movement and activity within the enclosing structure and to receive the impression that the structure is occupied by a human presence. This impression is created by the irregular and seemingly random passage of shadows and light across translucent window coverings as may be caused by normal activity within the structure and by the intermittent illumination and extinguishment of a secondary light source, e.g., in a water closet or kitchen of the structure such as may occur when the occupants pass to the water closet for relief or to the kitchen to procure snacks or beverages.

To operate the apparatus it is only necessary to place it upon a table or other suitable support in such a position that it will illuminate and randomly cast moving shadows upon drawn or closed translucent window coverings of windows which are prominently visible to the public view, i.e., from the street, and insert the power plug into the receptacle of a commercially available, electrically operated time switch which is plugged into an unswitched receptacle. A secondary light source, in another room, is connected by means of an extension cord which is plugged into the receptacle provided for that purpose on the base member of the apparatus. The timer switch is set for the desired hours of operation of the apparatus and the occupant may vacate the premises secure in the knowledge that the premises will be perceived as being occupied by a human presence.

While there has herein been described and illustrated the presently preferred form of the present invention, it should be understood that certain alterations, modifications, additions and deletions may be made thereto within the scope of the appended claims.

What I claim is:

1. A method of reducing the incidence of unauthorized entry into residential and commercial structures by providing the impression of occupancy by a human presence within such structures during the hours of darkness comprising the steps of:

a) providing a primary light source adapted for casting differing moving patterns of light and shadow upon and across the interior surfaces of translucent window coverings at a randomly variable frequency and speed of passage;

b) periodically causing the illumination and extinguishment of a secondary light source in a different room of such structures; and c) causing these events to occur on an apparently random basis.

2. The method of claim 1 wherein an observer on the exterior of said structures perceives human activity within said structures and is thereby deterred from attempting unauthorized entry for illegal purpose.

3. Apparatus for security enhancement including:

a) a base member having vertical sides and an inwardly turned circular flanged opening at the top thereof;

b) a pair of spaced apart horizontally disposed centralizing roller members rotatably attached to the underside of said flanged opening;

c) a diametrically traversing support shelf within said base member;

d) a lamp socket mounted centrally of said circular flanged opening upon said transverse shelf;

e) a clear incandescent lamp electrically operable in said socket;

e) a vertically rising rotating element support bracket mounted upon said transverse shelf;

f) a vertically rising mounting and securing stud at the upper center of said support bracket;

g) spacer washers or bushings at the top of said bracket encompassing said stud;

h) a transparent cylindrical rotating element having an open base and a closed top with ventilating holes and a central bore adapted to pass over said vertically rising stud at the center of said mounting bracket and is there retained by a suitable nut on said stud;

i) said transparent cylindrical element passing over said mounting bracket and central stud encompasses said incandescent lamp and extends downwardly into said circular flanged opening in said base member to a point below the elevation of said centralizing rollers;

j) a drive motor and reduction gear having an upwardly extending output shaft with a drive cam fixed thereupon pivotally mounted within said base member;

k) an extension spring attached to said pivotal assembly drawing said drive cam into driving engagement with said transparent cylindrical rotating element causing said cylindrical element to rotate in engagement with said centralizing rollers;

l) a switch having a roller actuator engaged with a cam-like portion on the lower edge of said rotating element, energizing and de-energizing an electrical circuit in response to the rotation of said cylindrical rotating element;

m) an electrical receptacle fixed in said base member electrically connected to said switch; and n) an electrical supply cord for connecting the apparatus through a photo-electric cell relay and timing means and thence to electric mains.

4. The apparatus of claim 3 wherein said centralizing roller means and said rotating drive cam means are separated by an angle of 120°.

5. The apparatus of claim 3 wherein said securement means comprises an ornamental internally threaded nut.

6. The apparatus of claim 3 wherein said vertically disposed transparent cylindrical rotating element comprises opaque designs.

7. The apparatus rotating element of claim 3 wherein said opaque designs cover 40 percent of the vertical and horizontal surfaces thereof of said transparent cylindrical rotating element.

8. The apparatus of claim 3 wherein said vertically disposed transparent cylindrical rotating element comprises a plurality of heat dissipating ventilating holes in the horizontal surface thereof.

9. The apparatus of claim 3 wherein said pivotal motor support and tensioning means comprises a journaled pivot pin.

10. The apparatus of claim 3 wherein said pivotal motor support and tensioning means comprises an extension spring.

11. The apparatus of claim 3 wherein said powered means for imparting rotation to said cylindrical element comprises an electric motor.

12. The apparatus of claim 3 wherein said powered means for imparting rotation to said cylindrical element comprises a reduction gear having an extended output shaft.

13. The reduction gear having an extended output shaft of claim 3 wherein said extended output shaft comprises a fixedly attached drive cam.

14. The drive cam of claim 3 wherein said drive cam is in operative engagement with said vertically disposed transparent cylindrical rotating element.

15. Apparatus for randomly casting light and shadows across the internal translucent surfaces of window coverings and completing and interrupting an electrical circuit to a remotely situate secondary light source thus providing the perception of occupancy to an external observer, comprising in combination:

a) a base member having vertical sides and an inwardly turned circular flanged opening at the top thereof, b) a plurality of spaced apart horizontally disposed centralizing roller members rotatably attached to the underside of said flanged opening;

c) a diametrically traversing support shelf within said base member;

d) a lamp socket mounted centrally of said circular flanged opening upon said transverse shelf;

e) a clear incandescent lamp electrically operable in said socket;

e) a vertically rotating element support bracket mounted upon said transverse shelf;

f) a vertically rising mounting and securing stud at the upper center of said support bracket;

g) spacer washers or bushings at the top of said bracket encompassing said stud;

h) a vertically disposed transparent cylindrical rotating element having an open base and a closed top with a plurality of ventilating holes and a central bore adapted to pass over and rotate upon said vertically rising stud at the center of said mounting bracket, whereupon it is rotatably retained and inhibited from departure therefrom by a suitable nut on said stud;

i) said transparent cylindrical element passing over said mounting bracket and central stud encompasses said incandescent lamp and extends downwardly into said circular flanged opening in said base member to a point below the elevation of said centralizing rollers;

j) a drive motor and reduction gear, having an upwardly extending output shaft with a drive cam fixed thereupon, pivotally mounted within said base member;

k) an extension spring attached to said pivotal assembly providing tensioning means to draw said drive cam into frictional driving engagement with said transparent cylindrical rotating element thereby causing said cylindrical element to rotate in engagement with said centralizing rollers;

l) a switch having a roller actuator engaged with a cam-like portion on the lower edge of said rotating element, energizing and de-energizing an electrical circuit in response to the rotation of said cylindrical rotating element;

m) an electrical receptacle fixed in said base member electrically connected to said switch, and;

n) an electrical supply cord for connecting said drive motor and said lamp socket of the apparatus through a photo-electric cell relay and timing means and thence to electric mains.

16. The apparatus of claim 1 wherein said base member, of a substantially octagonal cylindrical configuration comprises:

a) said vertically extending side(s);

b) said internally extending flange-like portion at the upper end thereof;

c) said circular opening in said flange-like portion;

d) said plurality of spaced-apart, horizontally disposed rotatable centralizing roller means upon vertical axes, approximately one-third the periphery of said rollers extending inwardly of the inner circumference of said circular opening;

e) said electrical receptacle;

f) said internal horizontal traversing shelf and bracket means adapted to receive, support and contain various internal components;

g) said vertically disposed cylindrical rotating element support bracket means fixedly attached upon and to said horizontally traversing shelf;

h) bearing and securement means adapted to rotatably retain said transparent cylindrical rotating element upon and to said support bracket;

i) said lamp socket centrally positioned upon said horizontally traversing shelf within said base member and extending upwardly therefrom;

j) said clear incandescent lamp having a vertically disposed filament operatively engaged in said lamp socket; and upwardly extending threaded stud;

k) said drive motor and reduction gear means for imparting rotation to said transparent cylindrical element.

17. The apparatus of claim 15 wherein said cylindrical transparent rotating element means comprises:

a) a closed upper end having a central bore adapted for rotatable mounting encompassing the said stud-like screw upwardly extending from the center of the width of the horizontal portion of said rotating element support bracket;

b) said plurality of spaced-apart ventilating holes in the circular upper horizontal surface thereof;

c) a plurality of random opaque designs upon the vertical and horizontal surfaces thereof covering approximately 40 percent of said surfaces; and d) singular, or a plurality of, cam-like extension(s), downwardly disposed, along and around segmental portions of the lower peripheral edge thereof.

18. The apparatus of claim 15 wherein said drive motor means comprises in combination:

a) an electric motor means of the alternating current variety having speed reduction gearing means unitarily and operatively connected thereto;

b) said rotatable output shaft means of an extended length;

c) powered rotating cam means operatively joined to said output shaft; and d) electric power means operatively connected to said electric motor.

19. The apparatus of claim 15 wherein said pivotal motor support and tensioned engagement means comprise in combination:

a) pivot bearing means in fixed engagement with the interior of said base member means;

b) pivot pin means operatively journaled in said pivot bearing;

c) said pivot pin being fixed to motor support arm means;

d) said motor/reduction gear/output shaft and drive cam means fixed to said motor support arm; and e) said combination being urged into tensioned engagement with cylindrical rotating element by extension spring means; and f) said cylindrical rotating element responsive to the tension imparted by said combination engages said centralizing roller means bringing all moving parts of the apparatus into operative engagement.

20. The apparatus of claim 15 wherein said secondary remote light source random switching means comprises in combination:

a) switch means having roller actuating means;

b) means for supporting said switch in co-operative alignment with the lower cammed edge of said cylindrical rotating element;

c) said switch actuating roller means in operative engagement with said lower cammed edge of said cylindrical rotating element;

d) said lower cammed edge of said cylindrical rotating element periodically depressing said actuating roller and closing said switch;

e) said lower cammed edge of said cylindrical rotating element periodically releasing said actuating roller and opening said switch;

f) said switch opening and closing an electrical circuit;

g) said electrical circuit passing to said randomly switched receptacle into which is plugged an external extension cord connected to a remote secondary light source.

* * * * *